US009016187B2

(12) United States Patent
Findlay

(10) Patent No.: US 9,016,187 B2
(45) Date of Patent: Apr. 28, 2015

(54) PUMP ACTION RIFLE AND ACTION LOCK MECHANISM

(71) Applicant: Smith & Wesson Corp., Springfield, MA (US)

(72) Inventor: David S. Findlay, Athol, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/044,153

(22) Filed: Oct. 2, 2013

(65) Prior Publication Data

US 2015/0089854 A1 Apr. 2, 2015

(51) Int. Cl.

| | |
|---|---|
| ***F41A 17/76*** | (2006.01) |
| ***F41A 19/47*** | (2006.01) |
| ***F41A 3/48*** | (2006.01) |

(52) U.S. Cl.

CPC . *F41A 19/47* (2013.01); *F41A 3/48* (2013.01); *F41A 17/76* (2013.01)

(58) Field of Classification Search

None

See application file for complete search history.

(56) References Cited

U.S. PATENT DOCUMENTS

| | | | | |
|---|---|---|---|---|
| 1,401,568 | A * | 12/1921 | Swebilius | 42/22 |
| 3,129,637 | A * | 4/1964 | Packard | 89/154 |
| 4,697,495 | A | 10/1987 | Beretta | |
| 7,562,614 | B2 | 7/2009 | Polston | |
| 7,987,763 | B1 * | 8/2011 | Sirkis et al. | 89/196 |
| 2010/0275484 | A1 * | 11/2010 | Bentley | 42/1.06 |
| 2011/0061523 | A1 | 3/2011 | Webb | |

FOREIGN PATENT DOCUMENTS

| | | |
|---|---|---|
| WO | 89/03970 | 5/1989 |

* cited by examiner

*Primary Examiner* — Stephen M Johnson

(74) *Attorney, Agent, or Firm* — John A. Chionchio, Esq.; Ballard Spahr, LLP

(57) ABSTRACT

An action lock for a Modern Sporting Rifle pump action firearm is pivotably mounted within the lower receiver of the rifle and has a stop surface that engages a contact surface on the bolt carrier when the bolt carrier is in battery. A cam on the hammer or the trigger engages a cam surface on the action lock when the hammer is released by a pull of the trigger. Cam action rotates the action lock out of engagement with the bolt carrier, unlocking it and allowing the fore end grip to be pumped to cycle the action and extract and eject the spent casing and strip and chamber a new round.

26 Claims, 7 Drawing Sheets

PUMP ACTION RIFLE AND ACTION LOCK MECHANISM

FIELD OF THE INVENTION

This invention relates to an action locking mechanism for Modern Sporting Rifle pump action firearms.

BACKGROUND

Modern sporting rifles may be operated in various modes. One mode of operation which has withstood the test of time is the pump action. Pump action firearms are largely insensitive to ammunition quality and therefore provide excellent reliability. Long associated with shotguns, the pump action uses the reciprocal motion of the fore end grip to strip a round from a magazine and chamber the round. To design a pump action rifle using the modern sporting rifle as a starting point, an action locking mechanism is necessary which will reliably lock the action in the forward or "locked" position and will also unlock the rifle's bolt carrier after the hammer has fallen firing the rifle, in order to cycle the firearm action.

SUMMARY

The invention concerns an action lock useable in a firearm having a movable bolt carrier. A hammer is pivotably mounted on the firearm. A cam is positioned on the hammer. A trigger is pivotably mounted on the firearm and operatively associated with the hammer. In an example embodiment, the action lock comprises a body mountable on the firearm. The body is movable between a first and a second position. The body has a stop surface engageable with the bolt carrier, to prevent motion thereof, when the body is in the first position. The stop surface is disengaged from the bolt carrier, to permit motion thereof, when the body is in the second position. The body further comprises a cam surface engageable with the cam on the hammer. The cam acts on the cam surface when the hammer pivots from a cocked position to a released position to move the body from the first position to the second position, thereby permitting motion of the bolt carrier.

In a particular example embodiment, the bolt carrier is in battery when the body is in the first position. By way of further example, the body is pivotably mountable on the firearm. The firearm may further comprise a safety or selector switch. In this example, the body may be pivotably mounted thereon. In another embodiment, the firearm may comprise a separate pivot pin that the body may be pivotably mounted on.

In an example embodiment, a spring is positioned between the body and a portion of the firearm. The spring biases the action lock into the first position. In a particular example embodiment, the spring is mounted on the body. By way of example, the spring may comprise a leaf spring. The spring biasing component could also be a compression spring or some other spring member.

In another example embodiment, the body further comprises a tab projecting outwardly away from the body and to the outside of the firearm. The tab allows the operator to manually move the action lock between the first and second positions.

In an example embodiment, the body has a U-shape comprising first and second legs positioned in spaced apart relation and joined by a cross piece. In this example the stop surface is positioned on one of the first and second legs. Further by way of example, the cam surface is positioned on one of the first and second legs. In a particular example embodiment, the body comprises a first tab mounted on the first leg and a second tab mounted on the second leg. In this example, each of the first and second tabs projects outwardly away from the body. The tabs provide for manually moving the action lock between the first and second positions.

The invention also encompasses a firearm. In one example embodiment, the firearm comprises a bolt carrier movable between an open position and a battery (locked up) position. A manually movable fore end grip is attached to the bolt carrier, or a handle is attached to the bolt carrier. A hammer is pivotably mounted on the firearm. A cam is positioned on the hammer. A trigger is pivotably mounted on the firearm and is operatively associated with the hammer. This example embodiment further includes an action lock comprising a body mounted on the firearm. The action lock is movable between a first and a second position. The body has a stop surface engageable with the bolt carrier, to prevent motion thereof, when the body is in the first position. The stop surface is disengaged from the bolt carrier, to permit motion thereof, when the body is in the second position. The body further comprises a cam surface engageable with the cam on the hammer. The cam acts on the cam surface when the hammer pivots from a cocked position to a released position to move the body from the first position to the second position, thereby permitting motion of the bolt carrier by the fore end grip or the handle.

In an example embodiment, the bolt carrier is in the battery position when the body is in the first position. In a particular example embodiment, the body is pivotably mounted on the firearm. The firearm may further comprise a safety or selector switch. In this example, the body may be pivotably mounted thereon. In another embodiment, the firearm may comprise a separate pivot pin that the body may be pivotably mounted on.

By way of example, a spring is positioned between the body and a portion of the firearm. The spring biases the action lock into the first position. In an example embodiment, the spring is mounted on the body. In an example embodiment, the spring comprises a leaf spring. The spring biasing component could also be a compression spring or some other spring member.

In another example embodiment, the firearm comprises a tab projecting outwardly away from the body. The tab allows an operator to manually move the action lock between the first and second positions. In a particular example embodiment, the body has a U-shape comprising first and second legs positioned in spaced apart relation and joined by a cross piece. By way of example, the stop surface is positioned on one of the first and second legs. Also by example, the cam surface is positioned on one of the first and second legs. In another example embodiment, a first tab is mounted on the first leg and a second tab is mounted on the second leg. Each of the first and second tabs projects outwardly away from the body. The tabs provide for manually moving the action lock between the first and second positions. In a particular example embodiment, the firearm is a rifle.

The invention further encompasses an action lock useable in a firearm having a movable bolt carrier, a trigger pivotably mounted on the firearm, and a cam positioned on the trigger. In one example embodiment, the action lock comprises a body mountable on the firearm and movable between a first and a second position. The body has a stop surface engageable with the bolt carrier, to prevent motion thereof, when the body is in the first position. The stop surface is disengaged from the bolt carrier, to permit motion thereof, when the body is in the second position. The body further comprises a cam surface engageable with the cam on the trigger. The cam acts on the cam surface, when the trigger pivots, to move the body from the first position to the second position, thereby permitting motion of the bolt carrier. In this example embodiment, the bolt carrier is in battery when the body is in the first position. By way of example, the body may be pivotably mountable on the firearm. The firearm may further comprise a pivot pin mounted thereon. In this example the body is pivotably mountable on the pivot pin. In a particular example embodiment, the pivot pin comprises a safety/selector switch.

In an example embodiment, the action lock comprises a spring positioned between the body and a portion of the firearm. The spring biases the action lock into the first position. By way of example, the spring may be mounted on the body. In a further example, the spring comprises a leaf spring.

By way of example, the action lock may further comprise a tab projecting outwardly away from the body. The tab provides for manually moving the action lock between the first and second positions. In a particular example embodiment, the body has a U-shape comprising first and second legs positioned in spaced apart relation and joined by a cross piece. By way of example, the stop surface may be positioned on one of the first and second legs. By way of further example, the cam surface may be positioned on one of the first and second legs. In another example, a first tab may be mounted on the first leg and a second tab may be mounted on the second leg. Each of the first and second tabs project outwardly away from the body. The tabs provide for manually moving the action lock between the first and second positions.

The invention further comprises a firearm comprising a bolt carrier movable between an open position and a battery position. In this example embodiment, means for manually moving the bolt carrier are also provided. A trigger is pivotably mounted on the firearm. In this particular example, a cam is positioned on the trigger. An action lock comprising a body is mounted on the firearm. In this example the action lock is movable between a first and a second position. The body has a stop surface engageable with the bolt carrier, to prevent motion thereof, when the body is in the first position. The stop surface is disengaged from the bolt carrier, to permit motion thereof, when the body is in the second position. In this example embodiment, the body further comprises a cam surface engageable with the cam on the trigger. The cam acts on the cam surface when the trigger pivots to move the body from the first position to the second position, thereby permitting motion of the bolt carrier by the means for manually moving the bolt carrier.

In an example embodiment, the bolt carrier is in the battery position when the body is in the first position. In a further example embodiment, the body is pivotably mounted on the firearm. By way of example, the firearm further comprises a pivot pin, the body being pivotably mounted thereon. In a particular example embodiment, the pivot pin comprises a safety/selector switch. By way of example, a spring may be positioned between the body and a portion of the firearm. The spring biases the action lock into the first position. In an example embodiment, the spring is mounted on the body. By way of example, the spring may comprise a leaf spring.

In a further example embodiment, a tab projects outwardly away from the body. The tab provides for manually moving the action lock between the first and second positions. In a particular example, the body has a U-shape comprising first and second legs positioned in spaced apart relation and joined by a cross piece.

By way of example, the stop surface may be positioned on one of the first and second legs. In a further example, the cam surface may be positioned on one of the first and second legs. In an example embodiment, the first tab may be mounted on the first leg and a second tab may be mounted on the second leg. Each of the first and second tabs project outwardly away from the body in this example embodiment. The tabs provide for manually moving the action lock between the first and second positions. In a particular example embodiment, the firearm is a rifle. By way of example, the means for manually moving the bolt carrier may comprise a movable fore end grip attached to the bolt carrier. In another example, the means for manually moving the bolt carrier may comprise a handle attached to the bolt carrier.

DETAILED DESCRIPTION

Figure 1:
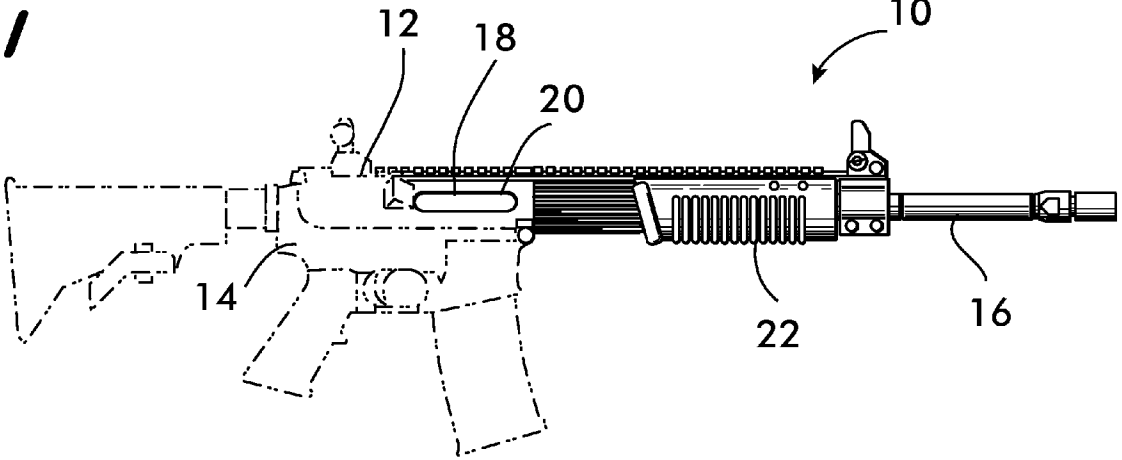
FIGS. 1 and 2 are right side views of a pump action firearm having an example action lock according to the invention.
Figure 2:
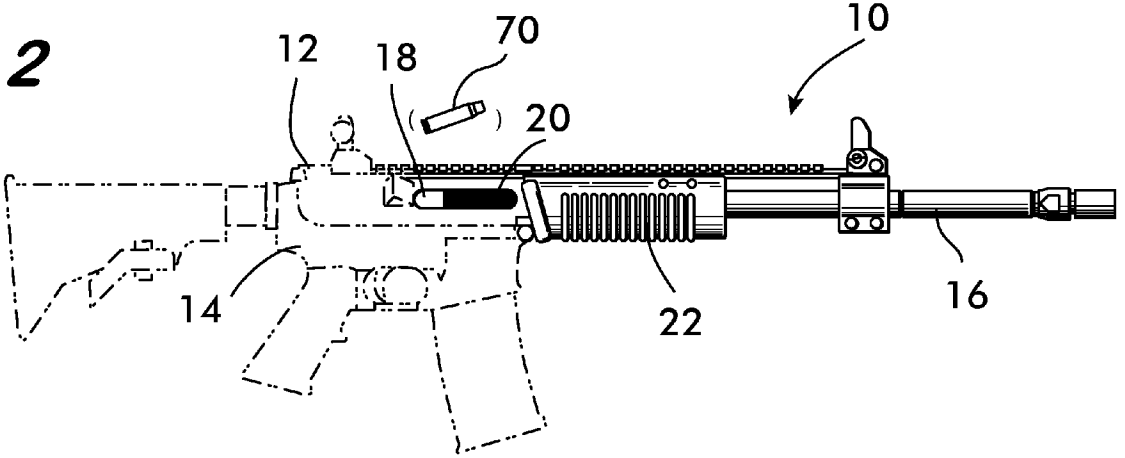
Figure 1A:
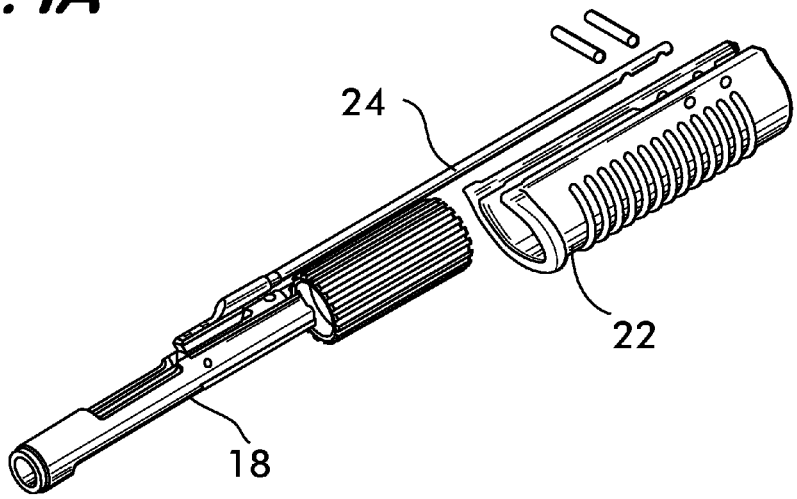
FIG. 1A is an isometric view of a bolt carrier assembly, barrel nut, and fore end grip assembly used in the firearm shown in FIGS. 1 and 2.

FIG. 1 shows a firearm, in this example, a pump action rifle 10 using an action lock (described below) according to the invention. Rifle 10 comprises an upper receiver 12 mounted to a lower receiver 14. A barrel 16 is mounted on the upper receiver 12 along with a bolt carrier 18, seen through the ejector port 20 and in detail in FIG. 1A. A fore end grip 22 is mounted beneath the barrel 16. As shown in FIG. 1A, fore end grip 22 is connected to the bolt carrier 18 via a connector rod 24. The fore end grip 22 is slidable lengthwise along barrel 16 (compare FIGS. 1 and 2) to move the bolt carrier between an action closed (or battery) position (FIG. 1) and an action open position (FIG. 2).

Figure 3:
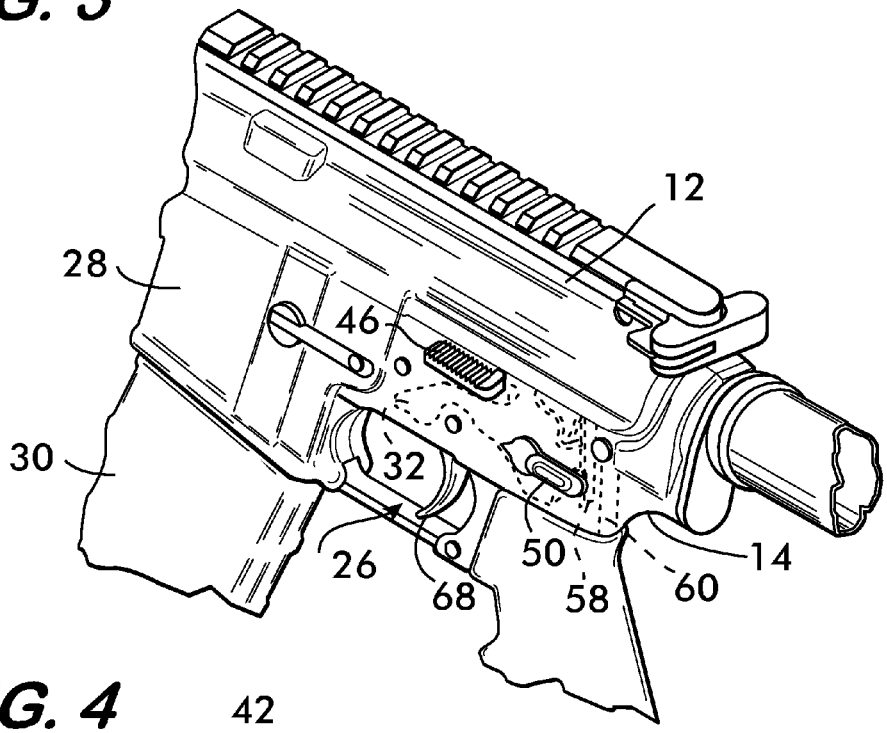
FIG. 3 is a left side isometric view of the upper and lower receiver of the firearm shown in FIG. 1.
Figure 4:
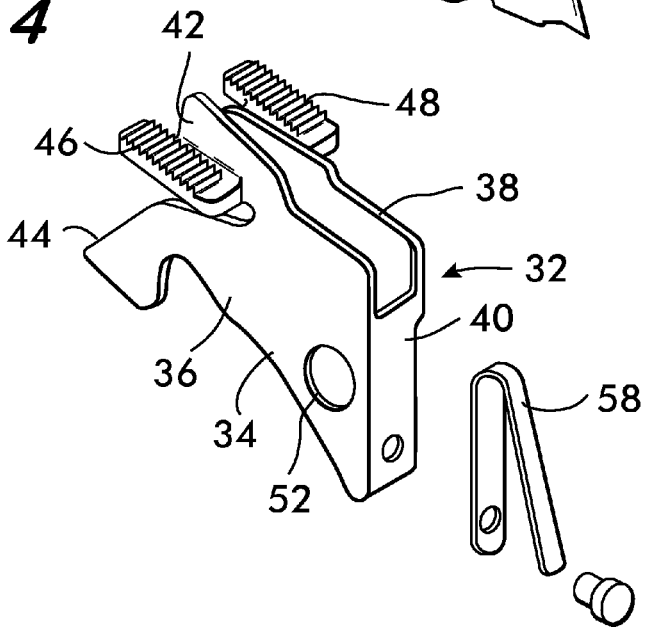
FIG. 4 is a detailed isometric view of an example action lock body.
Figure 5:
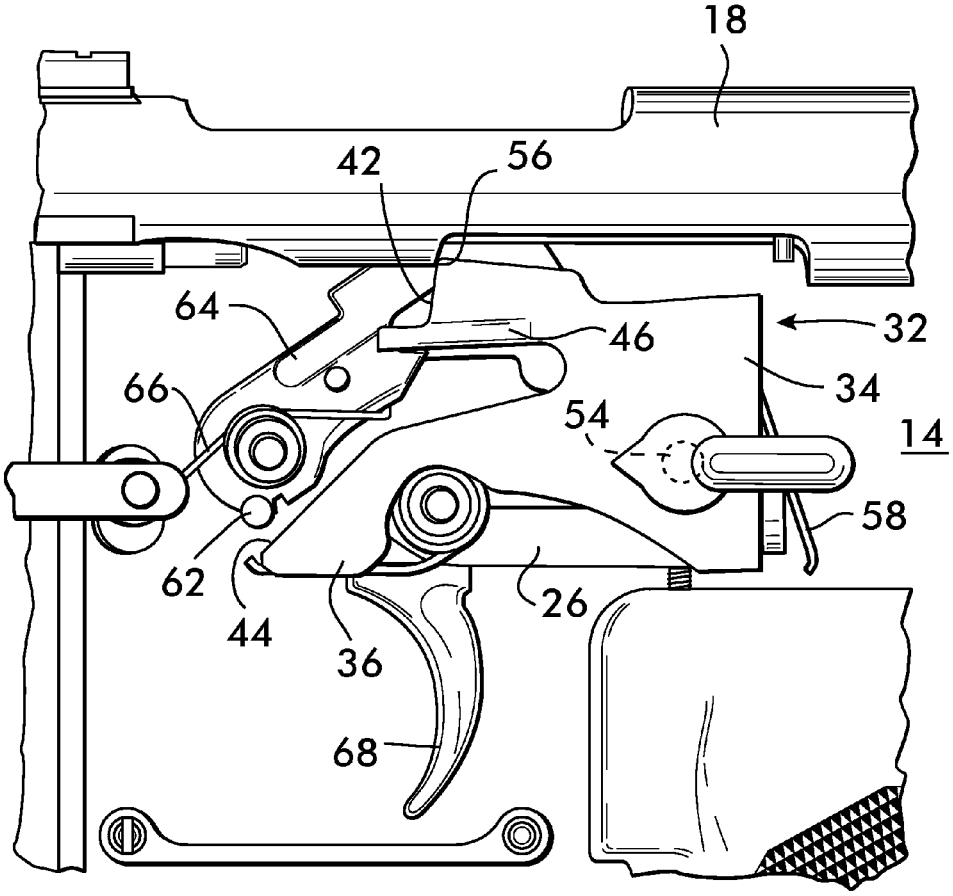
FIGS. 5 and 6 are left side views of the action lock, trigger assembly, hammer, and bolt carrier in action.

As shown in FIG. 3, lower receiver 14 houses a trigger assembly 26 (see also FIG. 5), a magazine well 28 receiving an ammunition magazine 30, and an action lock 32. Action lock 32 is shown in detail in FIG. 4 and comprises a body 34, in this example having a U-shape formed of legs 36 and 38 arranged in spaced apart relation and connected to one another by a cross piece 40. It is advantageous to form action lock body 34 from stamped sheet metal such as steel, although other materials and manufacturing methods are of course feasible (i.e. metal injection molding). As shown in FIGS. 4 and 5, a stop surface 42 is positioned on leg 36, the stop surface being engageable with the bolt carrier 18 as described below. A cam surface 44 (described below) is also positioned on leg 36. In this example of action lock body 34, tabs 46 and 48 are respectively mounted on legs 36 and 38. The tabs 46 and 48 project outwardly away from body 34 and extend outwardly from opposite sides of the lower receiver 14 (see FIG. 3) to permit ambidextrious manual operation of the action lock 32.

Figure 6:
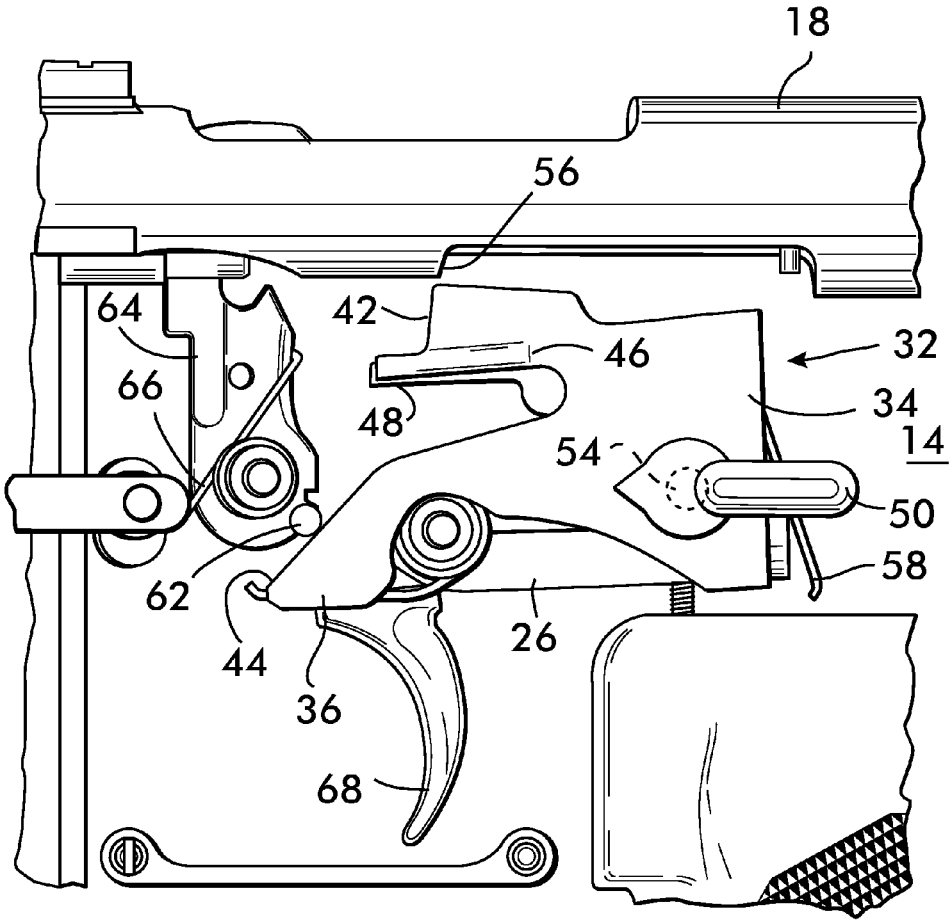

As shown in FIGS. 5 and 6, action lock 32 is movably mounted within the lower receiver 14. In this example, the action lock is pivotably mounted on the safety/selector switch 50, the opening 52 in leg 36 (see FIG. 4) receiving the selector switch pin 54 rotatably mounted within the lower receiver 14. The action lock could also be pivotably mounted on its own, separate pivot pin as well. Action lock 32 is movable (i.e., in this example, pivots about pin 54) between a first position where the stop surface 42 on leg 36 engages the bolt carrier 18 (FIG. 5), and a second position, shown in FIG. 6, where the stop surface is disengaged from the bolt carrier. Note that the bolt carrier 18 has a contact surface 56 which the stop surface 42 engages to permit locking engagement between the bolt carrier 18 and the action lock 32. When in the first position, shown in FIG. 5, the action lock 32 locks the bolt carrier 18 in battery, i.e., bolt closed and locked with the firing chamber of the barrel. When in the second position, shown in FIG. 6, the action lock 32 permits the fore end grip 22 to move the bolt carrier 18 out of battery and into the open position as shown in FIG. 2.

It is advantageous to bias action lock 32 into the first position. This is done using a spring positioned between the action lock and a portion of the lower receiver 14. In this example embodiment, as shown in FIGS. 3 and 4, the biasing spring comprises a leaf spring 58 mounted on the cross piece 40 of action lock body 34. The leaf spring 58 engages an internal surface 60 of the lower receiver 14 and biases body 34 in a clockwise sense when viewed from the left side of rifle 10. Other types of springs, such as coil springs, are of course feasible.

As shown in FIGS. 5 and 6, the cam surface 44 on leg 36 of the action lock body 34 is engageable with a cam 62 on a hammer 64 pivotably mounted within the lower receiver 14. Hammer 64 is biased by a spring 66 and is pivotably movable between a cocked position (FIG. 5) and a released position (FIG. 6). Hammer 64 is controlled by the trigger assembly 26, and when released from the cocked position upon a pull of the trigger 68, the hammer strikes a firing pin (not shown) located within the bolt carrier 18 to discharge a round in the chamber of barrel 16. When the hammer pivots from the cocked position of FIG. 5 to the released position of FIG. 6, cam 62 pivots counterclockwise (as seen from the left side of rifle 10) and engages cam surface 44 on leg 36. This causes the action lock body 34 to pivot about pin 54 of the safety/selector switch 50 against the biasing of leaf spring 58, thereby moving the action lock body 34 from the first to the second position and out of engagement with the bolt carrier 18.

Action Lock Operation

Operation of action lock 32 is described with reference to FIGS. 1, 2, 5 and 6. With a round in the chamber of barrel 16 and the hammer in the cocked position as shown in FIG. 5, the action lock body 34 is biased into the first position by leaf spring 58. In the first position, the stop surface 42 of action lock body 34 engages the contact surface 56 of the bolt carrier 18 and locks the bolt carrier in battery. As shown in FIG. 1, fore end grip 22 is fully forward. When trigger 68 is pulled it releases hammer 64. As shown in FIG. 6, hammer 64 pivots under the force of its spring 66 and strikes the firing pin (not shown) in the bolt carrier 18, discharging the round. As hammer 66 rotates so does the cam 62. The geometry of the hammer 66, the cam 62 mounted thereon, the cam surface 44 and the locking surface 42 of the action lock body 34 are such that the cam 62 moves the action lock body 34 out of engagement with the bolt carrier 18 after the round is discharged. Thus the bolt carrier 18 is released after discharge allowing the operator to cycle the firearm for the next shot by moving the fore end grip rearward (toward the receiver, see FIG. 2) and then forward (away from the receiver) to chamber another cartridge. As the cam 62 engages cam surface 44 it causes the action lock body 34 to pivot about pin 54 of the safety/selector switch 50 against the biasing of leaf spring 58, thereby moving the action lock body 34 from the first to the second position and out of engagement with the bolt carrier 18. This unlocks the bolt carrier 18, permitting the fore end grip to be moved rearward, thereby moving the bolt carrier from battery to the open position shown in FIG. 2. Rearward movement of the fore end grip extracts and ejects the spent shell casing 70 and cocks the hammer 66. As hammer 66 is cocked the cam 62 pivots clockwise (when seen from the left side of the rife) and out of engagement with the cam surface 44. This permits the action lock body 34 to rotate clockwise under the biasing force of leaf spring 58. As the fore end grip 22 is brought forward it moves the bolt carrier 18 from the open to the battery position. As it traverses the magazine well 28, the bolt carrier 18 strips a live round from the magazine 30 and forces it into the chamber of barrel 16. As the round is being chambered the contact surface 56 on the bolt carrier 18 aligns with and engages the stop surface 42 on leg 36 of the action lock body 34 (FIG. 5). This locks the bolt carrier 18 into battery and ready for discharge of a subsequent round.

Figure 7:
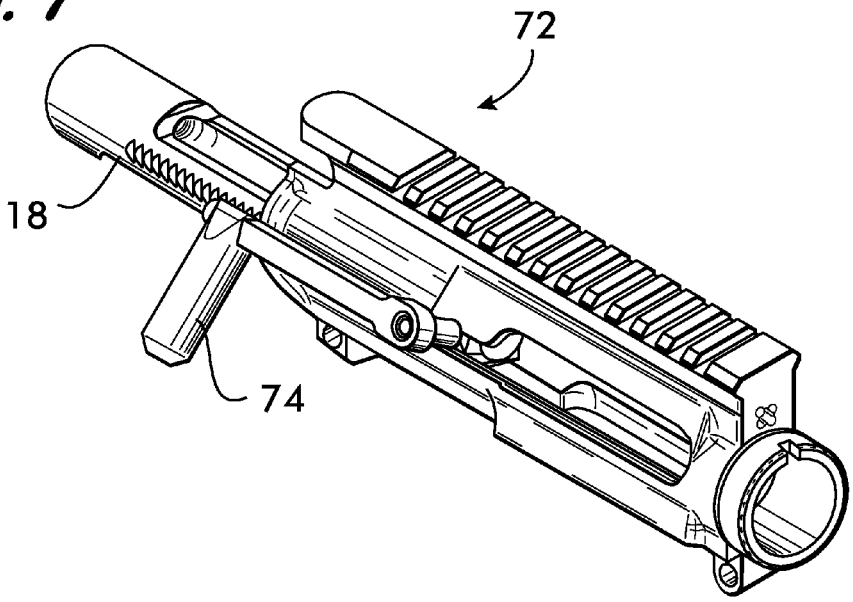
FIG. 7 is an isometric view of a portion of a straight pull firearm having the action lock according to the invention.

Although a pump action firearm is shown in the example embodiment, the action lock 32 according to the invention will also work in conjunction with a straight pull action firearm 72, a portion of which is shown in FIG. 7. In the straight pull action firearm, a handle 74 is attached directly to the bolt carrier 18. Operation is similar to that described for the pump action firearm, the difference being that the handle 74 is pulled back and pushed forward rather than the fore end grip of the rifle, which is fixed.

Figure 8:
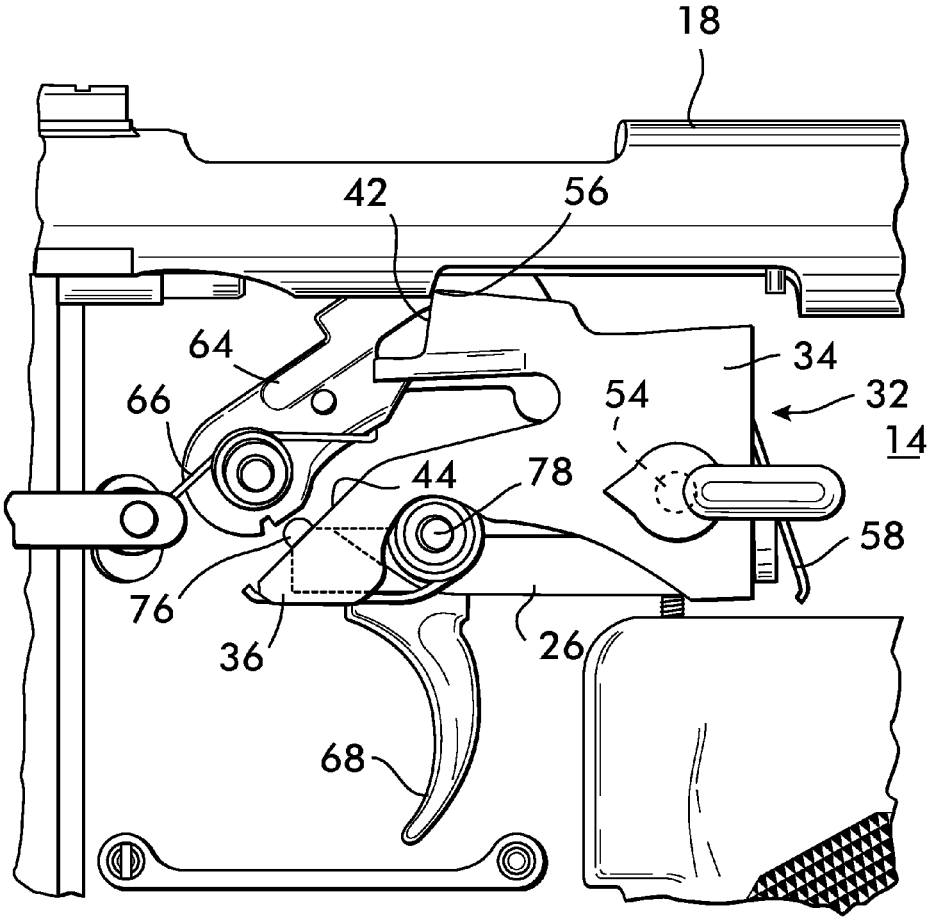
FIGS. 8 and 9 are left side views of an alternate embodiment of the action lock, trigger, hammer, and bolt carrier in action.
Figure 9:
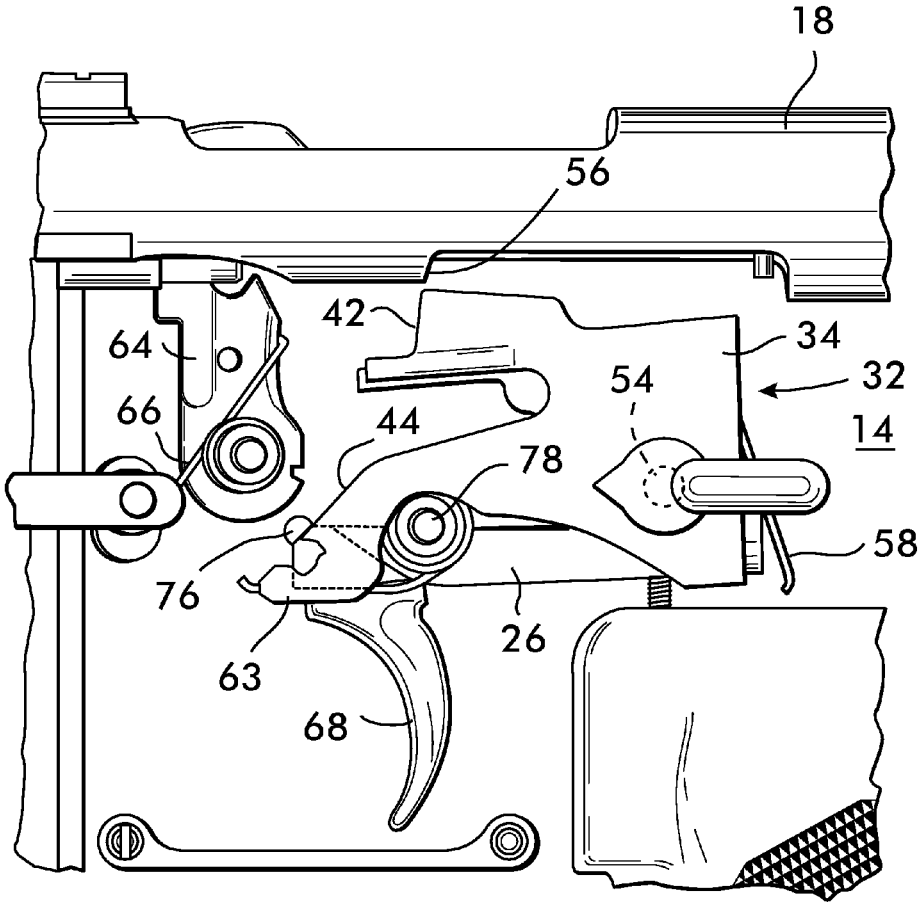

FIGS. 8 and 9 show an alternate embodiment of the action lock 32. The action lock 32 of the alternate embodiment is substantially as described above with respect to FIG. 4, but in this embodiment a cam 76 is mounted on the trigger assembly 26, and not the hammer 64.

As shown in FIGS. 8 and 9, action lock 32 is movably mounted within the lower receiver 14. In this embodiment, the action lock is pivotably mounted on the safety/selector switch, the opening 52 in leg 36 (see FIG. 4) receiving the selector switch pin 54 rotatably mounted within the lower receiver 14. The action lock could also be pivotably mounted on its own, separate pivot pin as well. Action lock 32 is movable (i.e., in this example, pivots about pin 54) between a first position where the stop surface 42 on leg 36 engages the bolt carrier 18 (FIG. 8), and a second position, shown in FIG. 9, where the stop surface is disengaged from the bolt carrier. Note that the bolt carrier 18 has a contact surface 56 which the stop surface 42 engages to permit locking engagement between the bolt carrier 18 and the action lock 32. When in the first position, shown in FIG. 8, the action lock 32 locks the bolt carrier 18 in battery, i.e., bolt closed and locked with the firing chamber of the barrel. When in the second position, shown in FIG. 9, the action lock 32 permits the fore end grip 22 to move the bolt carrier 18 out of battery and into the open position as shown in FIG. 2.

It is advantageous to bias action lock 32 into the first position. This is done using a spring positioned between the action lock and a portion of the lower receiver 14. In this example embodiment, as shown in FIGS. 3 and 4, the biasing spring comprises a leaf spring 58 mounted on the cross piece 40 of action lock body 34. The leaf spring 58 engages an internal surface 60 of the lower receiver 14 and biases body 34 in a clockwise sense when viewed from the left side of rifle 10. Other types of springs, such as coil springs, are of course feasible.

As shown in FIGS. 8 and 9, the cam surface 44 on leg 36 of the action lock body 34 is engageable with the cam 76 on the trigger assembly 26 pivotably mounted on a pin 78 within the lower receiver 14. Hammer 64 is biased by a spring 66 and is pivotably movable between a cocked position (FIG. 8) and a released position (FIG. 9). Hammer 64 is controlled by the trigger assembly 26, and when released from the cocked position upon a pull of the trigger 68, the hammer strikes a firing pin (not shown) located within the bolt carrier 18 to discharge a round in the chamber of barrel 16. When the trigger assembly 26 pivots about pin 78 from position shown in FIG. 8 to the position shown in FIG. 9, cam 76 pivots counterclockwise (as seen from the left side of rifle 10) and engages cam surface 44 on leg 36. This causes the action lock body 34 to pivot about pin 54 of the safety/selector switch against the biasing of leaf spring 58, thereby moving the action lock body 34 from the first to the second position and out of engagement with the bolt carrier 18.

Action Lock Alternate Embodiment Operation

Operation of the alternate embodiment of action lock 32 is described with reference to FIGS. 1, 2, 8 and 9. With a round in the chamber of barrel 16 and the hammer in the cocked position as shown in FIG. 8, the action lock body 34 is biased into the first position by leaf spring 58. In the first position, the stop surface 42 of action lock body 34 engages the contact surface 56 of the bolt carrier 18 and locks the bolt carrier in battery. As shown in FIG. 1, fore end grip 22 is fully forward. When trigger 68 is pulled it releases hammer 64. As shown in FIG. 9, hammer 64 pivots under the force of its spring 66 and strikes the firing pin (not shown) in the bolt carrier 18, discharging the round. As trigger 68 is pulled the trigger assembly 26 rotates about pin 78, and so does the cam 76 mounted thereon. The geometry of the trigger assembly 26, the cam 76 mounted thereon, the cam surface 44 and the locking surface 42 of the action lock body 34 are such that the cam 76 moves the action lock body 34 out of engagement with the bolt carrier 18 after the round is discharged. Thus the bolt carrier 18 is released after discharge allowing the operator to cycle the firearm for the next shot by moving the fore end grip rearward and then forward to chamber another cartridge. As the cam 76 engages cam surface 44 it causes the action lock body 34 to pivot about pin 54 of the safety/selector switch against the biasing of leaf spring 58, thereby moving the action lock body 34 from the first to the second position and out of engagement with the bolt carrier 18. This unlocks the bolt carrier 18, permitting the fore end grip to be moved rearward, thereby moving the bolt carrier from battery to the open position shown in FIG. 2. Rearward movement of the fore end grip extracts and ejects the spent shell casing 70 and cocks the hammer 66. As hammer 66 is cocked the cam 76 on trigger assembly 26 pivots clockwise (when seen from the left side of the rife) moving cam 76 away from the cam surface 44. This permits the action lock body 34 to rotate clockwise under the biasing force of leaf spring 58. As the fore end grip 22 is brought forward it moves the bolt carrier 18 from the open to the battery position. As it traverses the magazine well 28, the bolt carrier 18 strips a live round from the magazine 30 and forces it into the chamber of barrel 16. As the round is being chambered the contact surface 56 on the bolt carrier 18 aligns with and engages the stop surface 42 on leg 36 of the action lock body 34 (FIG. 8). This locks the bolt carrier 18 into battery and ready for discharge of a subsequent round.

Although a pump action firearm is shown in the example embodiment, the alternate embodiment of action lock 32 according to the invention will also work in conjunction with other means for manually moving the bolt carrier, such as a straight pull action firearm 72 as shown in FIG. 7. In the straight pull action firearm, a handle 74 is attached directly to the bolt carrier 18. Operation is similar to that described for the pump action firearm, the difference being that the handle 74 is pulled back and pushed forward rather than the fore end grip of the rifle, which is fixed.

The action lock according to the invention is expected to bring greater reliability to manually operated modern sporting rifles due to its insensitivity to ammunition quality as well as meet certain regulatory and feature-based compliance requirements that have been applied to modern sporting rifles in various states.

What is claimed is:

1. An action lock useable in a firearm having a movable bolt carrier, a hammer pivotably mounted on said firearm, a cam positioned on said hammer, a trigger pivotably mounted on said firearm and operatively associated with said hammer, said action lock comprising:

a body mountable on said firearm and movable between a first and a second position, said body having a stop surface engageable with said bolt carrier, to prevent motion thereof, when said body is in said first position, said stop surface being disengaged from said bolt carrier, to permit motion thereof, when said body is in said second position, said body further comprising a cam surface engageable with said cam on said hammer, said cam acting on said cam surface when said hammer pivots from a cocked position to a released position to move said body from said first position to said second position, thereby permitting motion of said bolt carrier, a tab projecting outwardly away from said body, said tab providing for manually moving said action lock between said first and second positions.

2. The action lock according to claim 1, wherein said bolt carrier is in battery when said body is in said first position.

3. The action lock according to claim 1, wherein said body is pivotably mountable on said firearm.

4. The action lock according to claim 3, wherein said firearm further comprises a pivot pin mounted thereon, said action lock being pivotably mountable on said pivot pin.

5. The action lock according to claim 4, wherein said pivot pin comprises a safety/selector switch.

6. The action lock according to claim 3, further comprising a spring positioned between said body and a portion of said firearm, said spring for biasing said action lock into said first position.

7. The action lock according to claim 6, wherein said spring is mounted on said body.

8. The action lock according to claim 6, wherein said spring comprises a leaf spring.

9. The action lock according to claim 1, wherein said body has a U-shape comprising first and second legs positioned in spaced apart relation and joined by a cross piece, said tab being mounted on said first leg.

10. The action lock according to claim 9, wherein said stop surface is positioned on one of said first and second legs.

11. The action lock according to claim 9, wherein said cam surface is positioned on one of said first and second legs.

12. The action lock according to claim 9, further comprising a second tab mounted on said second leg, said second tab projecting outwardly away from said body, said tabs providing for manually moving said action lock between said first and second positions.

13. A firearm, comprising:

a bolt carrier movable between an open position and a battery position;

a manually movable fore end grip attached to said bolt carrier;

a hammer pivotably mounted on said firearm;

a cam positioned on said hammer;

a trigger pivotably mounted on said firearm and operatively associated with said hammer;

an action lock comprising a body mounted on said firearm and movable between a first and a second position, said body having a stop surface engageable with said bolt carrier, to prevent motion thereof, when said body is in said first position, said stop surface being disengaged from said bolt carrier, to permit motion thereof, when said body is in said second position, said body further comprising a cam surface engageable with said cam on said hammer, said cam acting on said cam surface when said hammer pivots from a cocked position to a released position to move said body from said first position to said second position, thereby permitting motion of said bolt carrier by said fore end grip.

14. The firearm according to claim 13, wherein said bolt carrier is in said battery position when said body is in said first position.

15. The firearm according to claim 13, wherein said body is pivotably mounted on said firearm.

16. The firearm according to claim 15, further comprising a pivot pin, said body being pivotably mounted thereon.

17. The firearm according to claim 16, wherein said pivot pin comprises a safety/selector switch.

18. The firearm according to claim 16, further comprising a spring positioned between said body and a portion of said firearm, said spring for biasing said action lock into said first position.

19. The firearm according to claim 18, wherein said spring is mounted on said body.

20. The firearm according to claim 18, wherein said spring comprises a leaf spring.

21. The firearm according to claim 13, further comprising a tab projecting outwardly away from said body, said tab providing for manually moving said action lock between said first and second positions.

22. The firearm according to claim 13, wherein said body has a U-shape comprising first and second legs positioned in spaced apart relation and joined by a cross piece.

23. The firearm according to claim 22, wherein said stop surface is positioned on one of said first and second legs.

24. The firearm according to claim 22, wherein said cam surface is positioned on one of said first and second legs.

25. The firearm according to claim 22, further comprising a first tab mounted on said first leg and a second tab mounted on said second leg, each of said first and second tabs projecting outwardly away from said body, said tabs providing for manually moving said action lock between said first and second positions.

26. The firearm according to claim 13, wherein said firearm is a rifle.

* * * * *